United States Patent [19]

Klepacki

[11] Patent Number: 4,966,351

[45] Date of Patent: Oct. 30, 1990

[54] STIRRUP ADAPTER ASSEMBLY

[76] Inventor: Brian J. Klepacki, 6470 W. 74th Ave., Arvada, Colo. 80003

[21] Appl. No.: 439,342

[22] Filed: Nov. 21, 1989

[51] Int. Cl.[5] ..... A61G 13/00

[52] U.S. Cl. ..... 269/328

[58] Field of Search ..... 269/322–328, 269/77, 76; 128/84; 403/59, 93–94; 248/279, 285, 286

[56] References Cited

U.S. PATENT DOCUMENTS

| | | | |
|---|---|---|---|
| 4,617,916 | 10/1986 | LeVahn et al. | 269/328 |
| 4,702,465 | 10/1987 | McConnell | 269/328 |
| 4,796,846 | 1/1989 | Meier et al. | 269/328 |

FOREIGN PATENT DOCUMENTS

| | | |
|---|---|---|
| 25879 | 4/1981 | European Pat. Off. . |
| 3001070 | 7/1981 | Fed. Rep. of Germany . |
| 2589933 | 5/1987 | France . |

*Primary Examiner*—Robert C. Watson

*Attorney, Agent, or Firm*—Leon Gilden

[57] ABSTRACT

A special adapter assembly is mountable to the opposed sides of a conventional medical examination table, such as an angiographic medical exam table, and the assembly facilitates the attachment of conventional feet receiving stirrups. The assembly includes a pair of side rails along which the stirrups are slidably, adjustably movable to thus permit an expanded use of the medical table for pelvic examinations and the like.

1 Claim, 4 Drawing Sheets

Fig 6
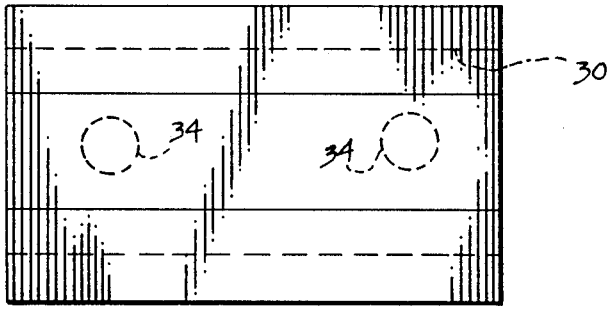
Fig 7
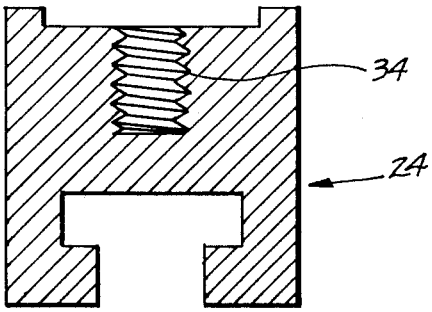
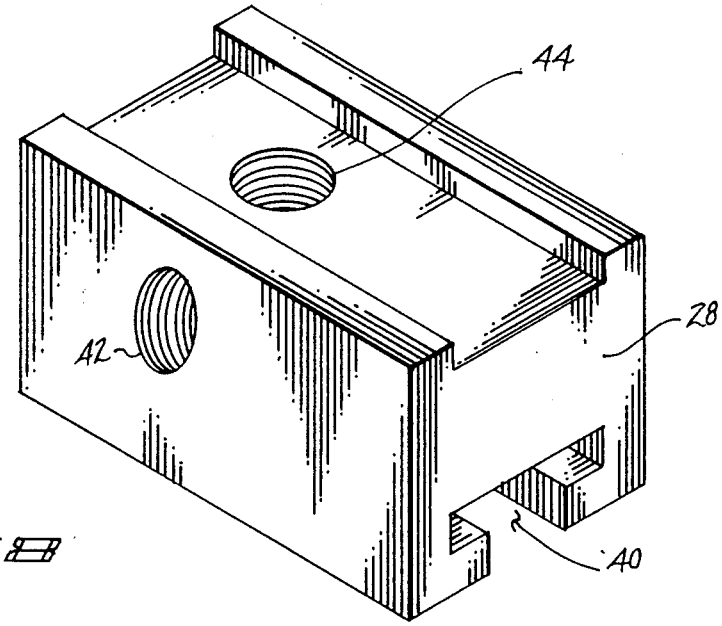
Fig 8

STIRRUP ADAPTER ASSEMBLY

BACKGROUND OF THE INVENTION

1. Field of the Invention

The present invention relates to medical examination tables, and more particularly to an adapter assembly which is mountable to an angiographic medical examination table or the like and which then permits the attachment of stirrups thereto.

2. Description of the Prior Art

As is well known in the prior art, certain medical examinations require that a patient be in a prone position with the patient's feet located in stirrups so as to position the legs in a bent or somewhat raised position. These stirrup assemblies are normally found on special medical examination tables which are designed specifically for the use of patient gynecological or rectal examinations. These specially designed tables normally have the stirrups adjustably mounted to slidable bars which are extensible from the tables.

Typical examples of gynecological or rectal medical examination tables wherein stirrup assemblies are slidably attached thereto are to be found in U.S. Pats. Nos. 3,944,205, which issued to F. Mueller on Mar. 16, 1976, and 4,046,365, which issued to S. Dungan on Sept. 6, 1977. As can be appreciated, medical professionals who only occasionally perform gynecological or rectal examinations on their patients frequently do not have access to the above-described medical examination tables which have stirrup assemblies attached thereto. As such, there appears to be a need for some means of attaching the stirrups to conventional medical examination tables which are not normally used in gynecological or rectal examinations, and in this respect, the present invention substantially addresses this need.

SUMMARY OF THE INVENTION

In view of the foregoing disadvantages inherent in the known types of medical examination tables now present in the prior art, whereby such tables are not provided with stirrup assemblies, the present invention provides an adapter arrangement which allows the attachment of stirrups to virtually any type of medical examination table, such as an angiographic medical examination table or the like. As such, the general purpose of the present invention, which will be described subsequently in greater detail, is to provide a new and improved stirrup adapter assembly which has all the advantages of the prior art stirrup arrangements and none of the disadvantages.

To attain this, a preferred embodiment of the present invention employs the use of a pair of adapter blocks on each side of an angiographic or similar medical examination table. A pair of these adapter blocks are mounted to an existing side rail on each side of the angiographic examination table, and a pair of extension bars are then mounted in the blocks on each side of the table. The extension bars are secured in a locked position by set screws extending through the adapter blocks, and the extension bars extend along the length of the table. A pair of further slidably movable stirrup holding blocks are then attached to the respective extension bars, and conventional stirrups can then be mounted in the stirrup holding blocks. The stirrups can be adjusted in position and locked therein by thumbscrews mounted in the stirrup holding blocks.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stirrup adapter assembly for a medical examination table which has all the advantages of the prior art stirrup assemblies for medical examination tables and none of the disadvantages.

It is another object of the present invention to provide a new and improved stirrup adapter assembly for a medical examination table which may be easily and efficiently manufactured and marketed.

It is a further object of the present invention to provide a new and improved stirrup adapter assembly for a medical examination table which is of a durable and reliable construction.

An even further object of the present invention is to provide a new and improved stirrup adapter assembly for a medical examination table which is susceptible of a low cost of manufacture with regard to both materials and labor, and which accordingly is then susceptible of low prices of sale to the consuming public, thereby making such stirrup adapter assembly for medical examination tables economically available to the buying public.

Still yet another object of the present invention is to provide a new and improved stirrup adapter assembly for a medical examination table which provides in the apparatuses and methods of the prior art some of the advantages thereof, while simultaneously overcoming some of the disadvantages normally associated therewith.

Still another object of the present invention is to provide a new and improved stirrup adapter assembly which is particularly designed for use with an angiographic medical examination table.

Yet even another object of the present invention is to provide a new and improved stirrup adapter assembly which is attachable to a conventional medical examination table for the purpose of allowing such table to be utilized as a gynecological or rectal examination table.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION FO THE DRAWINGS

The invention will be better understood and objects other than those set forth above will become apparent when consideration is given to the following detailed description thereof. Such description makes reference to the annexed drawings wherein:

FIG. 6 is a front elevation view of the adapter block shown in FIG. 5.

FIG. 7 is an end elevation view of the adapter block.

FIG. 8 is a perspective view of a stirrup holding block forming a part of the present invention.

DESCRIPTION OF THE PREFERRED EMBODIMENT

Figure 1:
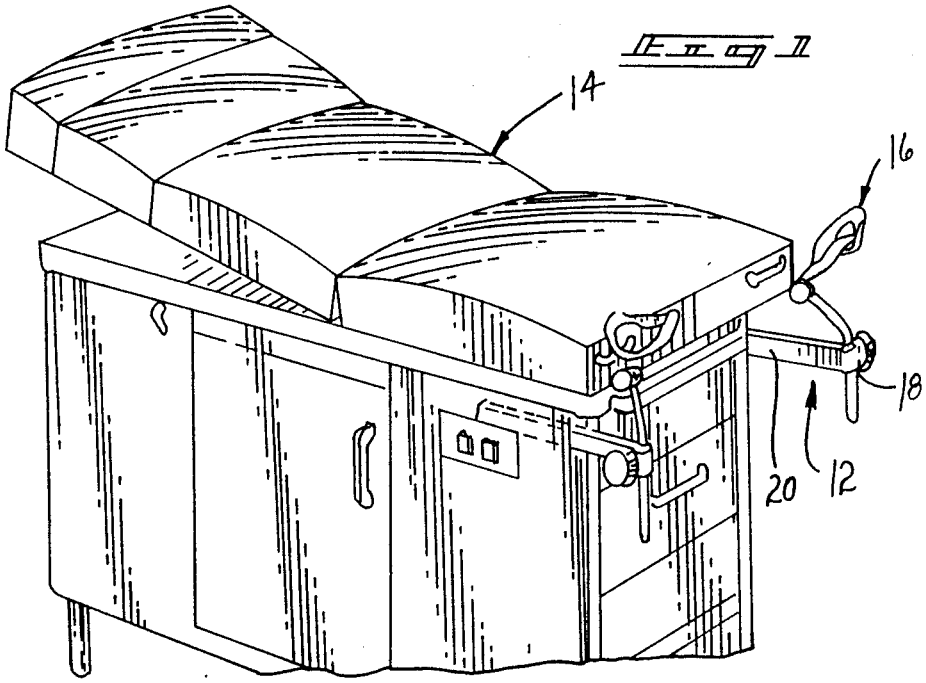
Fig 1 PRIOR ART
FIG. 1 is a perspective view of a conventional prior art gynecological or rectal medical examination table.

With reference now to the drawings, a new and improved stirrup adapter assembly for an angiographic medical examination table or the like embodying the principles and concepts of the present invention and generally designated by the reference numeral 10 will be described.

Figure 2:
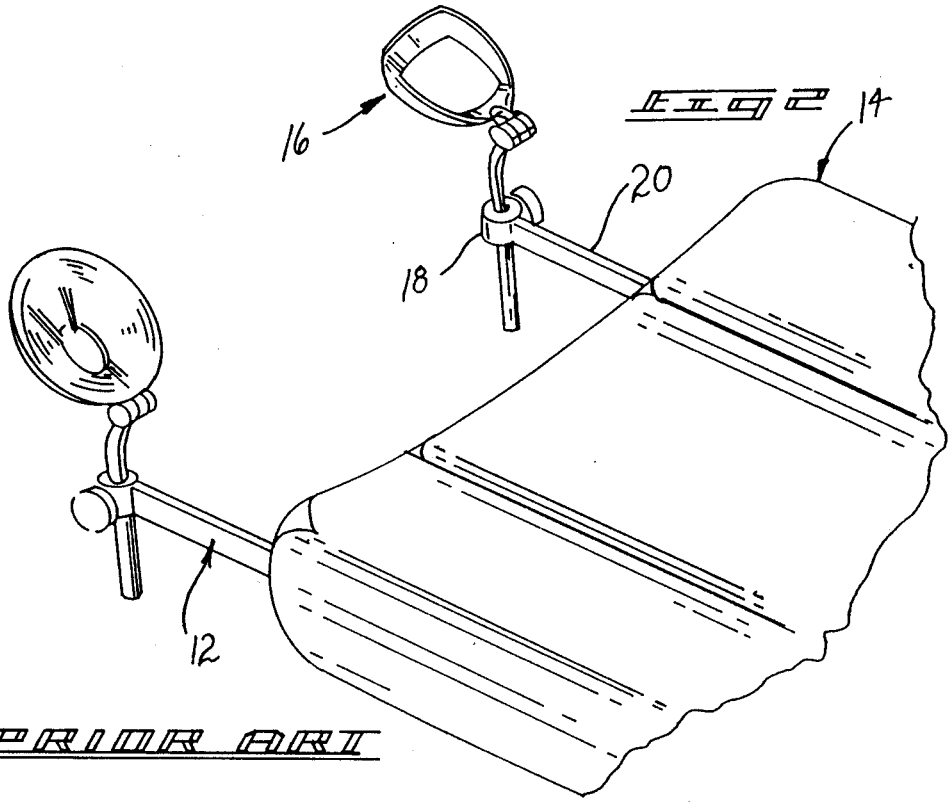
Fig 2 PRIOR ART
FIG. 2 is a partial perspective view of a prior art gynecological or rectal medical examination table.

With particular reference to FIGS. 1 and 2 of the drawings, it is well known that conventional prior art stirrup assemblies 12 are normally only mounted on specially designed gynecological or rectal examination tables 14. Typically, these prior art stirrup assemblies include stirrups 16 per se adjustably mounted in holders 18 which are integrally or otherwise attached to slidably extensible support bars 20. These extensible support bars 20 are retained in special grooves or holding slots which are constructed during the manufacture of the examination tables 14. These stirrup assemblies 12 are not manufactured for adaptable use with other types of medical examination tables, such as angiographic medical exam tables.

Figure 3:
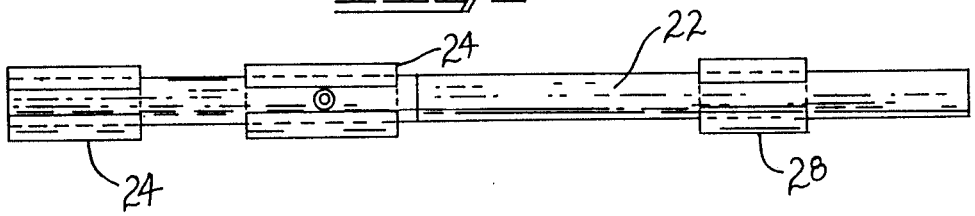
FIG. 3 is a front elevation view of an assembled form of the stirrup adapter assembly comprising the present invention.
Figure 4:
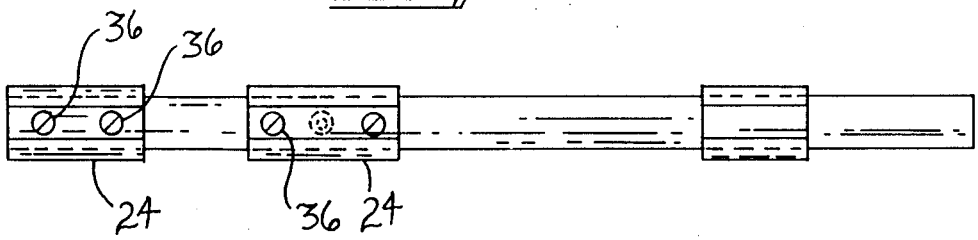
FIG. 4 illustrates a manner of attachment of the present invention to an existing side rail of a conventional medical examination table.

FIGS. 3 and 4 of the drawings partially illustrate the construction of the adapter stirrup assembly 10 comprising the present invention. Recognizing that an angiographic medical examination table has a pair of side rails 22 which are conventionally attached along half the length of each side of the table, the present invention 10 includes components designed to be attached to each of these side rails 22 whereby conventional stirrups 16 can be adjustably attached to the table. More specifically, a pair of adapter blocks 24 are attachable to each side rail 22, and a stainless steel extension bar 26 is slidably positioned within the adapter blocks 24. Additionally, each extension bar 26 has a stirrup holding block 28 slidably positioned thereover, and such stirrup holding block includes means, as will be subsequently described, for holding the aforementioned stirrups 16.

Figure 5:
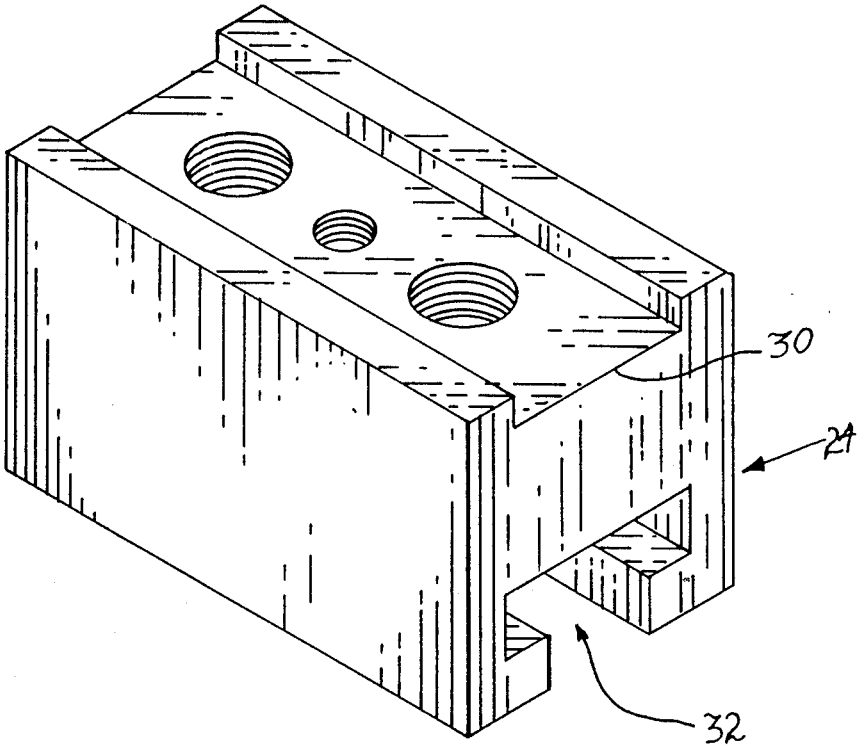
FIG. 5 is a perspective view of an adapter block forming a part of the present invention.

FIGS. 5, 6 and 7 more particularly illustrate the construction of an adapter block 24. In the preferred embodiment, each adapter block 24 will be manufactured from a strong lightweight metal such as aluminum or the like. Each block 24 will include a wide rectangularly shaped groove 30 extending along the complete axial length thereof and being designed to receive the aforementioned extension bar 26. A pair of threaded apertures 34 extend partially through each adapter block 24 and serve to receive threaded fasteners 36 which extend through provided apertures in each extension bar 26 for the purpose of fixedly securing the extension bar to the adapter blocks.

As also illustrated in FIGS. 5, 6, and 7, an opposed rear surface of each adapter block 24 is provided with a T-shaped groove 32 which extends along a complete axial length thereof, and this groove allows the adapter blocks 24 to be slidably positioned over and attached to an existing side rail 22 on a conventional angiographic medical examination table 38. Once an adapter block 24 has been positioned over an existing side rail 22 by slidably receiving the same in the T-shaped groove 32, any conventional fastening means, if desired, can be employed to lockably secure an adapter block to the side rail—although such locking fasteners are not necessarily required if a tight slidable fit is achieved between a side rail and adapter block.

Figure 9:
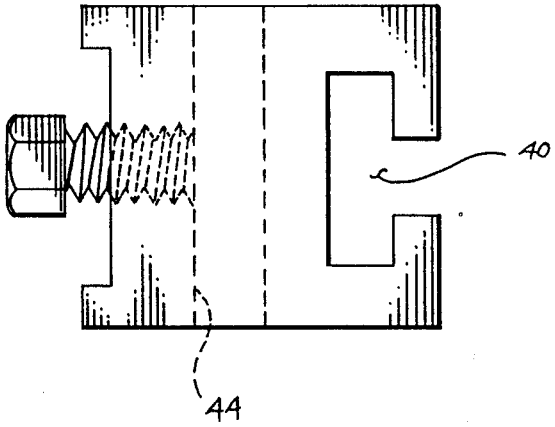
FIG. 9 is an end elevation view of the stirrup holding block.
Figure 10:
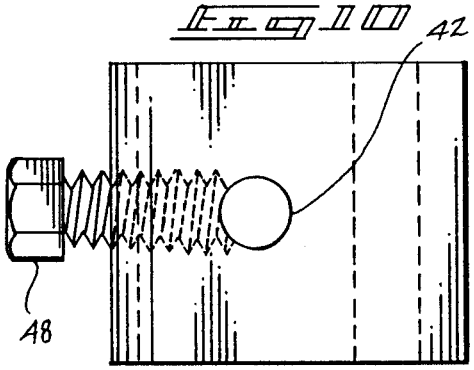
FIG. 10 is a top plan view of the stirrup holding block.
Figure 12:
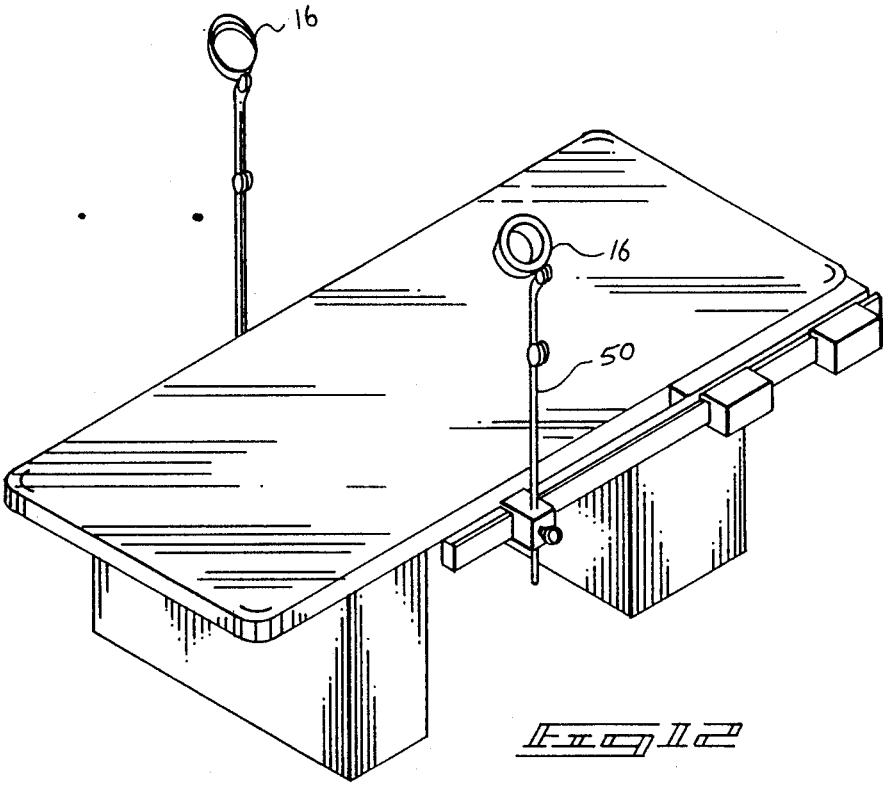
FIG. 12 illustrates the present invention attached to an angiographic medical examination table.

With reference to FIGS. 8, 9 and 10 of the drawings, a more specific description of the stirrup holding blocks 28 forming a part of the present invention 10 will be provided. In this respect, it will be noted that each stirrup holding block 28 includes a T-shaped groove 40 extending along an axial length thereof and being designed to slidably position the stirrup holding block over an extension bar 26. A through-extending aperture 42 extends completely through each stirrup holding block 28 from a top to bottom portion thereof, and a further threaded aperture 44 communicates with and is orthogonally aligned to the aperture 42. A hand tightenable thumbscrew 48 is threadably retained within the aperture 44 and is used to securely fasten a stirrup 16 in a locked position relative thereto. In this connection, the stirrup 16, as shown in FIGS. 1, 2 and 12, includes a downwardly extending support rod 50 which is slidedly retained within the aperture 42 in a now apparent manner. As such, the thumbscrew 48 allows for the vertical adjustment of a stirrup 16 to a desired usable height.

Figure 11:
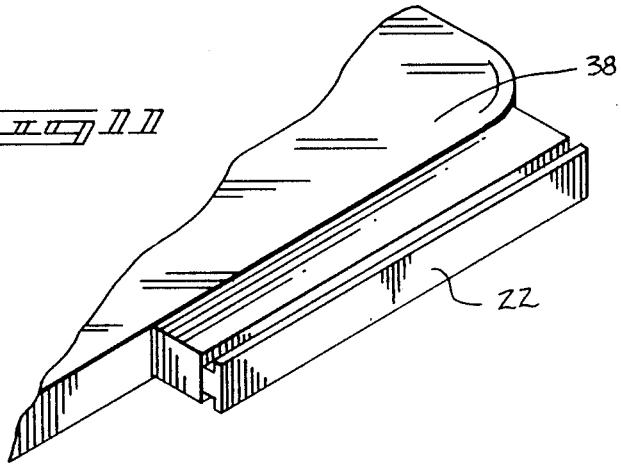
FIG. 11 is a partial perspective view of an angiographic medical examination table illustrating one of the conventional side rails associated therewith.

With respect to the manner of usage and operation of the present invention 10, FIGS. 11 and 12 illustrate the manner of attachment of a stirrup adapter assembly 10 to the existing side rail 22 of a conventional angiographic medical examination table. More specifically, with an extension bar 26 attached to a pair of adapter blocks 24 by means of threaded fasteners 36, the adapter blocks can be slidably positioned over an existing side rail 22 by aligning the T-shaped grooves 32 therewith. A stirrup holding block 28 is then slidably positioned over an extension bar 26 by means of the T-shaped groove 40, and a stirrup support rod 50 is then positioned through the aperture 42 until the stirrup assembly 16 is at a desired usable height. By an appropriate tightening of the thumbscrew 48 then, the stirrup assembly 16 is locked in position at the chosen height and horizontal positioning can be achieved by slidably moving the stirrup holding block along the extension bar 26 as best illustrated in FIG. 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved stirrup adapter assembly for use with a medical examination table, said assembly comprising, adapter block means operably attachable to an existing side rail of said medical examination table, extension bar means operably attachable to said adapter block means; and stirrup holding block means adjustably attached to said extension bar means spaced from the adapter block means, and wherein said medical examination table is an angiographic medical examination table, and wherein said adapter block means includes at least one adapter block, the adapter block including a top surface and a bottom surface, the bottom surface including a extensive "T" shaped groove to receive said existing side rails, thereby to fixedly secure said adapter block to said medical examination table, and the top surface including a coextensive groove, the recessed groove including a plurality of threaded bores directed into the adapter block from the groove wherein the threaded bores extend forward the "T" shaped groove but terminate within the block, and a fastening member receivable within each threaded bore and directed through the extension bar means to secure the extension bar means within the groove, and wherein said stirrup holding block means includes a stirrup holding block having a "T" shaped groove slidably positionable over said extension bar means, and wherein said stirrup holding block further includes a first through-extending aperture for receiving a support bar associated with a stirrup, and wherein said stirrup holding block includes a second aperture for receiving a threaded fastener, said second aperture intersecting the first aperture, said threaded fastener serving to fixedly secure said stirrup within said first through extending apertures.

* * * * *